US009139313B2

(12) United States Patent
Camilotti et al.

(10) Patent No.: US 9,139,313 B2
(45) Date of Patent: Sep. 22, 2015

(54) SYSTEM AND COMPACT METHOD OF BOTTLING GAS

(76) Inventors: Daniel Camilotti, Dallas, TX (US); Flavio Camilotti, Wylie, TX (US)

( * ) Notice: Subject to any disclaimer, the term of this patent is extended or adjusted under 35 U.S.C. 154(b) by 223 days.

(21) Appl. No.: 13/817,443

(22) PCT Filed: Nov. 22, 2010

(86) PCT No.: PCT/BR2010/000379
§ 371 (c)(1),
(2), (4) Date: Feb. 16, 2013

(87) PCT Pub. No.: WO2012/021953
PCT Pub. Date: Feb. 23, 2012

(65) Prior Publication Data

US 2013/0153084 A1 Jun. 20, 2013

(30) Foreign Application Priority Data

Aug. 20, 2010 (BR) ..... 1002740

(51) Int. Cl.
*B65B 31/02* (2006.01)
*B65B 3/30* (2006.01)
(Continued)

(52) U.S. Cl.
CPC ..... *B65B 3/30* (2013.01); *B65B 31/003* (2013.01); *B65B 31/025* (2013.01); *B65B 31/047* (2013.01); *F17C 6/00* (2013.01); *F17C 9/00* (2013.01); *F17C 2201/0109* (2013.01); *F17C 2201/032* (2013.01); *F17C 2201/035* (2013.01); *F17C 2201/054* (2013.01); *F17C 2201/058* (2013.01); *F17C 2205/013* (2013.01); *F17C 2205/018* (2013.01); *F17C 2205/0111* (2013.01); *F17C 2205/0126* (2013.01); *F17C 2205/0165* (2013.01); *F17C 2205/0308* (2013.01); *F17C 2205/0326* (2013.01); *F17C 2221/035* (2013.01); *F17C 2223/0153* (2013.01); *F17C 2223/033* (2013.01); *F17C 2225/0153* (2013.01); *F17C 2225/033* (2013.01); *F17C 2227/0142* (2013.01); *F17C 2227/047* (2013.01);
(Continued)

(58) Field of Classification Search
CPC .... B65B 31/003; B65B 31/025; B65B 31/047
USPC ..... 141/3, 83, 94–95, 98, 197, 237, 141/369–370
See application file for complete search history.

(56) References Cited

U.S. PATENT DOCUMENTS 2,469,434 A * 5/1949 Hansen et al. ..... 62/50.2
3,208,574 A * 9/1965 Anson ..... 194/216
(Continued)

FOREIGN PATENT DOCUMENTS

FR 2855893 A1 12/2004
JP 2001206134 A 7/2001
WO 2010130913 A1 11/2010

*Primary Examiner* — Nicolas A Arnett
(74) *Attorney, Agent, or Firm* — Alvin R. Wirthlin

(57) ABSTRACT

The present invention relates to a system and compact method of bottling gas (1), that can be installed in any the retail sales establishment to bottle cylinders (3) directly to the consumer, or in vehicles to bottle the cylinders (3) in the residences where they are consumed, the compact system of bottling gas (1) comprising a device for transfer of gas, from a reservoir (2) to gas cylinders (3) located in closed compartments (4), allowing the consumer a choice of quantity of gas and further eliminating the inconveniences of exchanging the cylinder (3) or its transport to remote locations for refill.

22 Claims, 8 Drawing Sheets

(51) Int. Cl.

| | |
|---|---|
| ***B65B 31/00*** | (2006.01) |
| ***B65B 31/04*** | (2006.01) |
| ***F17C 6/00*** | (2006.01) |
| ***F17C 9/00*** | (2006.01) |

(52) U.S. Cl.

CPC .... *F17C 2250/032* (2013.01); *F17C 2250/043* (2013.01); *F17C 2250/0421* (2013.01); *F17C 2250/0439* (2013.01); *F17C 2260/024* (2013.01); *F17C 2265/06* (2013.01); *F17C 2270/0134* (2013.01); *F17C 2270/0171* (2013.01); *F17C 2270/0745* (2013.01)

(56) References Cited

U.S. PATENT DOCUMENTS

| | | | | |
|---|---|---|---|---|
| 3,799,218 | A * | 3/1974 | Douglass | 141/18 |
| 4,153,083 | A * | 5/1979 | Imler et al. | 141/4 |
| 4,856,565 | A * | 8/1989 | Schoeffl et al. | 141/97 |
| 4,862,931 | A * | 9/1989 | Vella | 141/1 |
| 5,513,678 | A * | 5/1996 | Schultz et al. | 141/4 |
| 5,953,682 | A * | 9/1999 | McCarrick et al. | 702/45 |
| 6,655,422 | B2 * | 12/2003 | Shock | 141/83 |
| 6,827,084 | B2 * | 12/2004 | Grubb, Jr. | 128/204.22 |
| 6,904,913 | B2 * | 6/2005 | Aylsworth et al. | 128/204.22 |
| 7,150,280 | B2 * | 12/2006 | Aylsworth et al. | 128/204.22 |
| 7,249,617 | B2 * | 7/2007 | Musselman et al. | 141/231 |
| 7,578,292 | B2 * | 8/2009 | Musselman et al. | 128/200.24 |
| 7,621,302 | B2 * | 11/2009 | Shock et al. | 141/95 |
| 7,762,289 | B2 * | 7/2010 | McCulloh et al. | 141/2 |
| 7,823,609 | B2 * | 11/2010 | Wonders | 141/2 |
| 8,156,972 | B2 * | 4/2012 | Burns et al. | 141/349 |
| 8,375,948 | B2 * | 2/2013 | Turiello | 128/205.26 |
| 8,381,726 | B2 * | 2/2013 | Turiello | 128/205.26 |
| 8,413,653 | B2 * | 4/2013 | Turiello | 128/204.21 |
| 8,443,800 | B2 * | 5/2013 | Turiello | 128/204.21 |
| 8,701,718 | B1 * | 4/2014 | Turiello | 141/2 |
| 8,733,355 | B2 * | 5/2014 | Turiello | 128/205.26 |
| 2004/0079441 | A1 * | 4/2004 | Richey et al. | 141/83 |
| 2008/0084306 | A1 * | 4/2008 | Durtschi et al. | 340/572.1 |
| 2009/0178675 | A1 * | 7/2009 | Turiello | 128/202.13 |
| 2010/0089489 | A1 * | 4/2010 | Turiello | 141/2 |

* cited by examiner

SYSTEM AND COMPACT METHOD OF BOTTLING GAS

BACKGROUND OF THE INVENTION (1) Field of the Invention

The present invention relates to a system and compact method of bottling gas, that can be installed in any retail sales establishment to bottle cylinders directly to the consumer, or be installed in vehicles that can thus bottle gas cylinders in locations where it is used, avoiding its exchange or transport to the supplier company.

(2) Description of Related Art

Pipeline systems for supplying gas are known for residences, their distribution network not yet reaching all metropolitan regions, making it necessary to use cylinders in locations not encompassed by such a network.

Consumers exchange the cylinders as soon as their content finishes, this exchange being able to be done, for example, directly in businesses that fill the cylinders, or await the passage of a truck of the supplier that, on scheduled dates, makes its sales with exchange of cylinders at the location.

These cylinder exchange systems have some disadvantages, such as the cost of transporting the cylinders between the company and the residences, whether they are empty or full, which is added to the product. Moreover, the cylinders experience wear in this transport or in their storage, requiring their maintenance and painting, which also increases the cost of the product.

Another disadvantage still is the exchange of cylinders without the complete exhaustion of their content. This occurs because, for fear that the gas finishes in the middle of cooking, the consumer exchanges the cylinder before it is empty, since he does not receive any reimbursement for the gas contained therein.

In order to make possible the sale of a determined quantity of gas, avoiding not only excessive filling of gas in cylinders, but also allowing the consumer to pay for only the gas bottled, there are filling systems that include dosing devices that assist in calculating the quantity of gas to bottle. These systems allow determining the density of the gas contained in the gas tank, choosing the density of the gas in the cylinder, calculating a predetermined quantity of gas to add to the cylinder, controlling the gas flow, etc.

In a disadvantageous way, although efficient, these filling systems are very complex, include many parts and are heavy. Moreover, they include many measurement and calculation devices, and in the event of failure of any one of them, filling is impaired or even made impossible.

Another disadvantage of these dosing devices is due to their not possessing any constructive arrangement that makes possible their use in vehicles filling gas cylinders.

BRIEF SUMMARY OF THE INVENTION

In order to solve these inconveniences, the present invention presents a system and compact method of bottling gas that can be installed in any location or vehicle. In this way, the present system can be installed in retail sales establishments, such as fuel stations, which allows the user himself to take the cylinder to the location and to fill it. Or still, it can be installed in vehicles that go to residences, bottling the gas directly in the location of its use and in front of the consumer.

The present system and compact method of bottling gas represent a considerable reduction in the cost of transporting and preserving the cylinders, making possible a reduction in the final price of the product sold to the consumer.

Using the same trucks that currently serve to exchange cylinders, there is advantageously a reduction in the expenses for moving this vehicle, because they represent only the weight of the gas properly speaking, and no longer the weight of the cylinders, thus making possible a better exploitation of its load capacity.

The present system and method can be used in trucks, vans, motorcycles with sidecar, etc., which makes refilling possible in locations difficult to access, where trucks cannot go.

On installing the present system in retail sales posts, there is a bigger reduction in the value of the product, because the transportation cost is not added to that of the product, since it is the consumer himself who moves with the cylinder for purposes of refilling.

The present invention further presents a gas dosing device associated with the compact system for bottling gas that makes possible the bottling of a determined quantity of gas. It is of simple construction and works similar to a syringe, whose body is equipped with a gas input and output, its piston being moved from one extremity to another along the body, allowing the body to be filled with gas on withdrawal of the piston, and expelling the gas into a gas cylinder when the piston advances against the body.

The present system and dosing device further comprise a processing and management unit, and temperature sensors that, integrated in a computer program, exactly calculates the volume of gas according to the information received from the temperature sensor. The program calculates the mass or weight of the gas, according to its volume and temperature, determining how far back the piston must be, which is measured by a position sensor, so that the desired quantity of gas enters the said dosing device, to then be bottled when the piston is moved forward.

In order to better elucidate the present system and compact method of bottling gas, schematic drawings are presented below of one particular embodiment of the invention, whose dimensions and proportions are not necessarily real, because the drawings only serve to instructively present its various aspects, whose scope of protection is determined only by the purpose of the attached claims.

BRIEF DESCRIPTION OF THE SEVERAL VIEWS OF THE DRAWINGS

The system and compact method of bottling gas will be described below based on the attached drawings, in which.

DETAILED DESCRIPTION OF THE INVENTION

Figure 1:
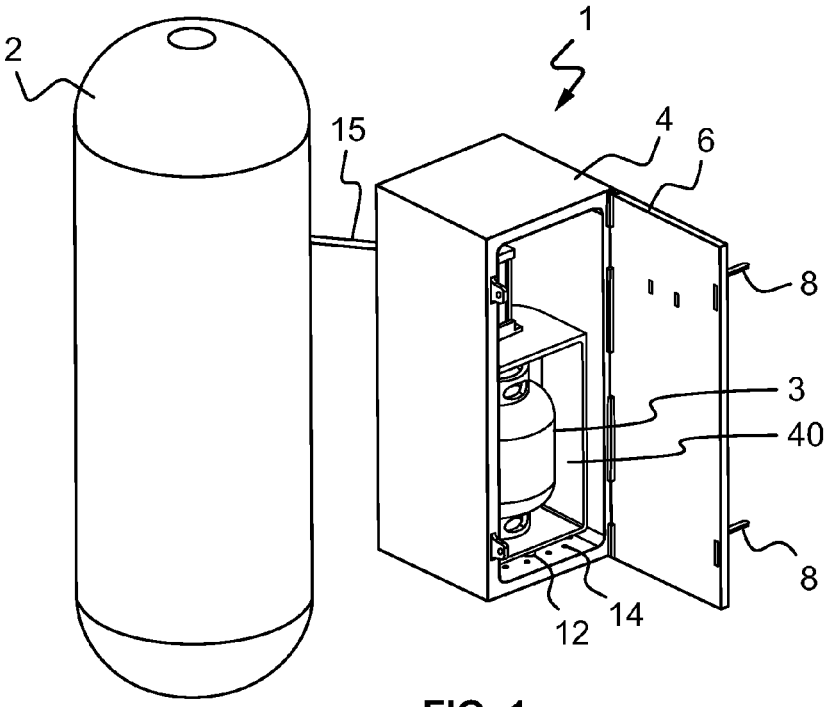
FIG. 1 shows a schematic perspective view of the compact system of bottling gas (1) of the present invention.

As illustrated in the attached drawings, the present invention deals with a compact system of bottling gas (1) that can be installed in retail sales establishments (see FIG. 6), or in a vehicle (see FIGS. 5, 7 and 11), for reloading gas cylinders (3).

The compact system of bottling gas (1) comprises a gas reservoir (2) for filling gas cylinders (3); at least one compartment (4) equipped with a cradle (13), defined in non-limiting way as a recess, in its base to accommodate cylinders (3). The mentioned cradle (13) is supported on a weight measurement system (12), arranged on the base of the compartment (4) that is closed by a door (6). Each compartment (4) comprises a retractable support (10) of a fast coupler (9), and a gas hose (15) that connects the reservoir (2) to the coupler (9), the said fast coupler (9) can be coupled to a connecting assembly (7) with safety valve, already incorporated in the cylinders (3) to be bottled.

The mentioned safety valve of the connecting assembly (7) is associated with an overload controlling mechanism (not shown), arranged in the internal part of the cylinder (3), the said mechanism being responsible for locking the safety valve, interrupting the gas input in the cylinder (3).

Figure 3:
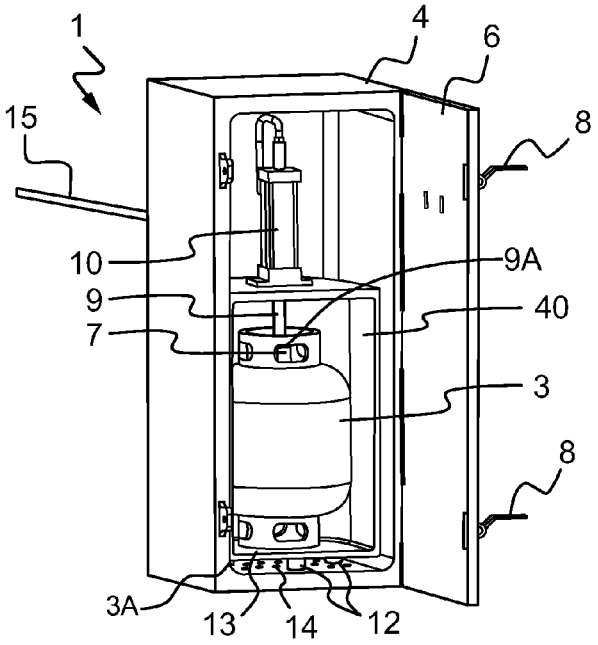
FIG. 3 shows a frontal perspective view of the interior of compartment (4) with gas cylinder (3)

Preferably, there is a pressure sensor 9A (FIG. 3); between the output of the reservoir (2) and the coupler (9) that allows monitoring the pressure of the system (1). In particular, the mentioned pressure sensor 9A (FIG. 3); is located in the coupler (9), which allows monitoring the internal pressure of the cylinder (3). In this way, when the internal pressure of the cylinder (3) exceeds a maximum value of its capacity, refilling of the cylinder (3) can be terminated. In case the cylinder (3) is completely loaded, the overload controlling mechanism automatically locks the safety valve of the connecting assembly (7). After this locking, the gas pressure of the supply system will rise, it being identified by the pressure sensor, terminating the refilling of cylinder (3).

Transfer of the gas from reservoir (2) to cylinder (3) is carried out by any known device of the prior art, for example, pump, dosing device, etc.

Optionally, the cradle (13) incorporates a box (40), conveniently fastened to the compartment (4), that can be used to support the retractable support (10) on its upper surface, the support (10) being located centered with the cradle (13), so as to allow precise control of the coupler (9) in relation to the connector (7) of the cylinder (3). In this way, the cylinder (3) is supported in the cradle (13) of the mentioned box (40), arranged on the measurement system (12), and the coupler (9) is precisely coupled to the connector (7).

Preferably, the mentioned measurement system (12) is a scale equipped with load cells for monitoring and control of the weight of the gas cylinder (3).

The system (1) further comprises a counterflow valve (not shown) in the hose (15), to prevent return of the gas from the cylinder (3) to the reservoir (2), in case the pressure inside the cylinder (3) is greater than the pressure inside the reservoir (2).

The compact system of bottling gas (1) further comprises a control panel (5) with a coupled processing and management unit that, through a loaded computer program, manages the operation of the system (1). The mentioned program manages the various functions of the system (1), such as the movement of the connection of the coupler (9) in the connecting assembly (7);

reception of the weight measurement of the cylinder (3) located in the cradle (13) of the compartment (4); reception of the weight measurement of the cylinder (3) after bottling; allows the choice of a quantity of gas to be bottled; notifies when the pressure or weight limit of the gas in the cylinder (3) is reached, and also monitors the validity date of the cylinder (3).

The said system (1) also comprises reading means (not shown), that identify and interpret the information specified by the manufacturer, referring to the validity date of the cylinder (3). This reading can be done by optical means, by a chip, installed on the cylinder (3), or by any other device that ensures reading of the validity date of the cylinder (3). In case this validity date has expired, the computer program informs the processing and management unit so that the refill is cancelled.

The mentioned joint connector (7) allows both the coupling of a fast coupler (9) for bottling of gas, as well as a coupling for use of the gas in a stove (not shown). The fast coupler (9) is any one suited for coupler in a connecting assembly (7) of gas cylinder (3), for example, of the bobtail type.

The measurement system (12) is used to check the weight of the cylinder (3) before and after the refill, as well as the quantity of gas applied, that can be complete filling of the cylinder (3) or a quantity defined by the user himself, in accordance with the value that he desires to pay. In this way, the measurement system (12) communicates with the program loaded in the processing and management unit, reporting when the predetermined quantity of gas was bottled, or when the predetermined maximum weight of the full cylinder was reached, through the weight measurement of the cylinder (3), plus the weight of the bottled gas, thus terminating the refill.

The compartment (4) is closed by the mentioned door (6) equipped with a connection means (8) to prevent cylinder (3) from being erroneously removed during its refill. The connection means (8) is actuated upon closing the door (6) and is unlocked on termination or cancellation of the bottling of the gas. The compartment (4) further comprises vents (14) that allow the escape of gas, in case there occurs emptying during the refill, avoiding them being confined inside the compartment (4).

Figure 2:
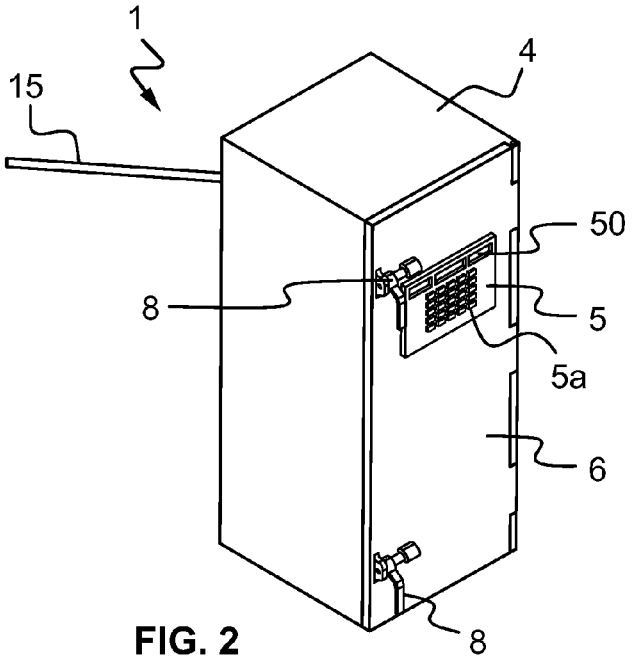
FIG. 2 shows a schematic perspective view of a compartment (4) of the present system (1)

In order to facilitate visualization of the various steps of refilling cylinders (3), the present system (1) comprises a digital display (50) in the control panel (5) (FIGS. 2, 5 and 6), where it is possible to visualize the initial weight data of the cylinder (3), chosen refill value; finishing of the refill procedure;

pressure limit reached; maximum load reached; etc. The display (50) is located preferably above the compartment (4). Payment for the bottled gas can be carried out by any means, such as credit or debit card, cash, fuel voucher, etc.

Figure 4:
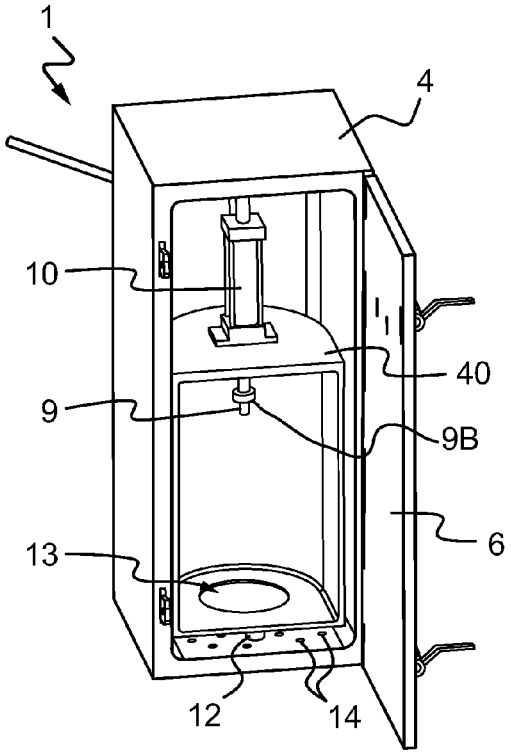
FIG. 4 shows another frontal perspective view of the interior of compartment (4) without cylinder (3)

The system (1) further comprises a sensor 9B (FIG. 4); of the presence of non-coupling, partial coupling or disarrangement of the fast coupler (9) in relation to the connecting assembly (7), that detects the situation of non-connection or partial connection between the coupler (9) and the connector (7), sending a signal to the program controlling the bottling, for cancellation of the refill.

In particular, the present system (1) further comprises a gas dosing device (D) to inject gas in the cylinder (3). It is installed in the hose (15) of the gas output of the reservoir (2), so as to inject gas in the cylinder (3) through the coupler (9).

The dosing device (D) has a form similar to a syringe and is equipped with a hollow body (D2), a piston (D3) inserted in the body (D2), which is movable along it. The said body (D2) is equipped with a gas input (D4) and output (D5), so that, on moving the piston (D3) in the direction opposite to the input (D4) of the body (D2), an internal chamber (D6) is formed that is filled with gas from the input (D4). This chamber (D6) is emptied on moving the piston (D3) in the direction of the input (D4) of the body (D2), so as to expel the gas through the output (D5).

Figure 8:
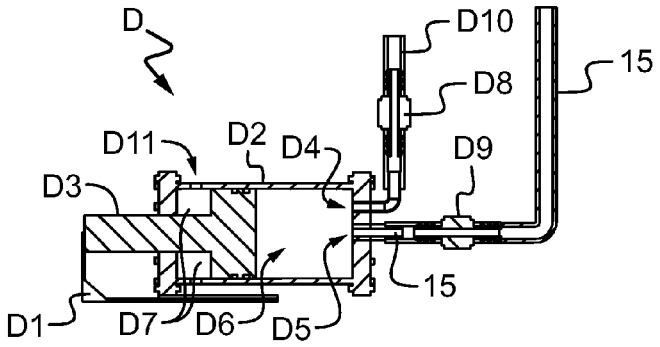
FIG. 8 shows a cross section view of the gas dosing device (D)
Figure 9:
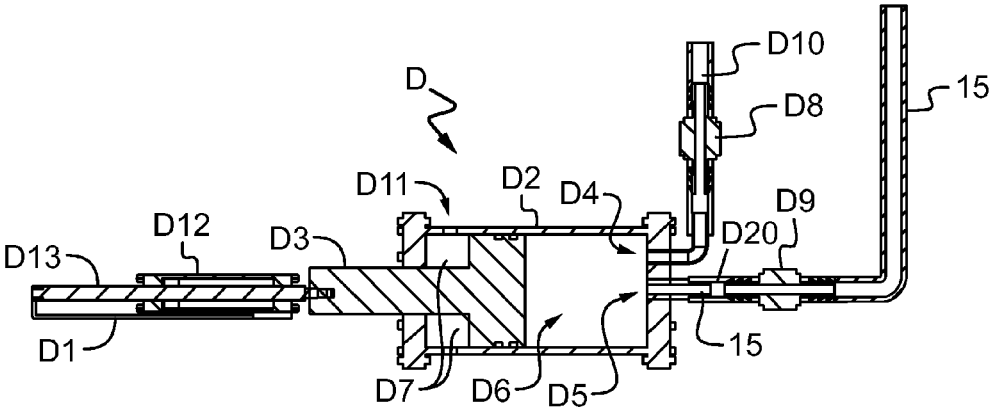
FIG. 9 shows a cross section view of a constructive variant of the gas dosing device gas (D)
Figure 10:
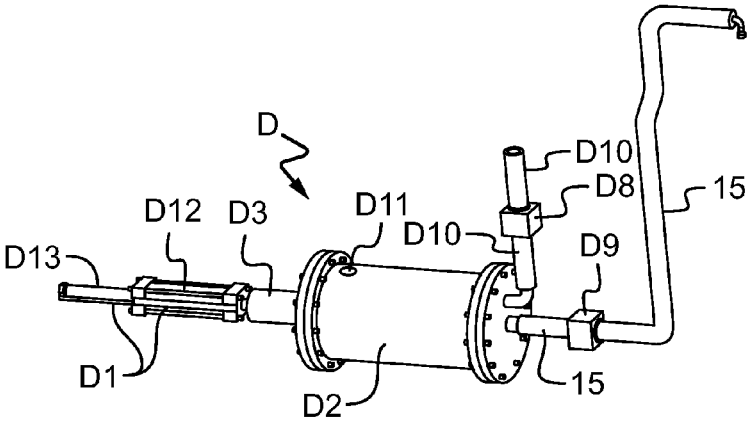
FIG. 10 shows a perspective view of the dosing device (D) of FIG. 9; and, FIG. 11 shows a lateral view in partial cross section of the dosing device (D) located inside the gas reservoir (2)

The dosing device (D) comprises temperature sensors D20 (FIG. 8); arranged in the body (D2) and/or in the hose (15), and sensor (D1) of the position of the piston (D3), being that the said sensors communicate with the program loaded in the processing and management unit of the panel (5) of the system (1), which receives and processes the information of the mentioned sensors.

The mentioned temperature sensors D20; necessary due to the fact of GLP gas experience volumetric variations, because of the influence of the temperature. In this way, the processing and management unit will do an average of the readings obtained through the sensors and will determine the proportional advance of the piston (D3), in order to define precisely the quantity of gas to be bottled, the advance of the piston (D3) being monitored by the position sensor (D1).

The body (D2) is internally divided in two chambers (D6, D7) by the piston (D3), the first chamber (D6) being a temporary gas reservoir that supplies the cylinder (3), whereas the second chamber (D7) is used to assist the movement of the piston (D3) on injecting fluids through its opening (D11), causing the advance of the piston (D3) against the chamber (D6).

Figure 7:
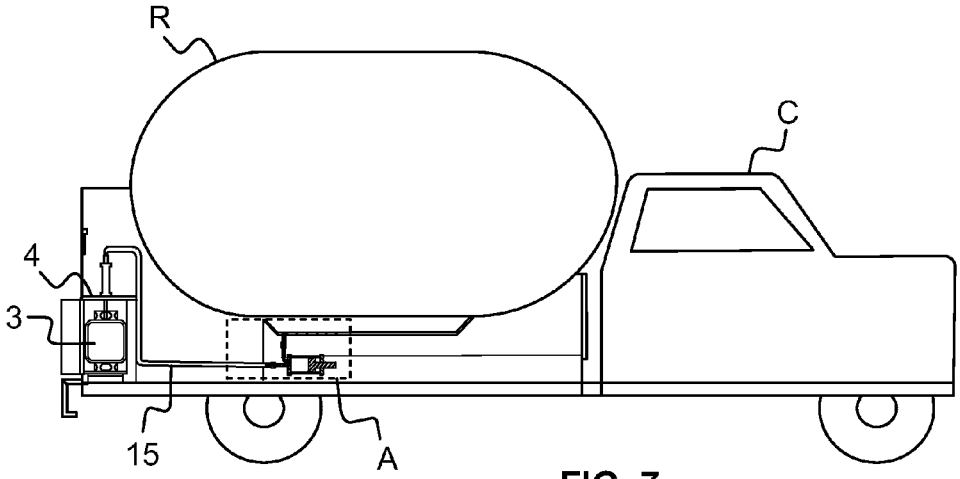
FIG. 7 shows a lateral view in partial cross section of a gas dosing device (D) coupled to the present system (1), where the dosing device (D) is located outside the gas reservoir (2) of a truck (C)
Figure 11:
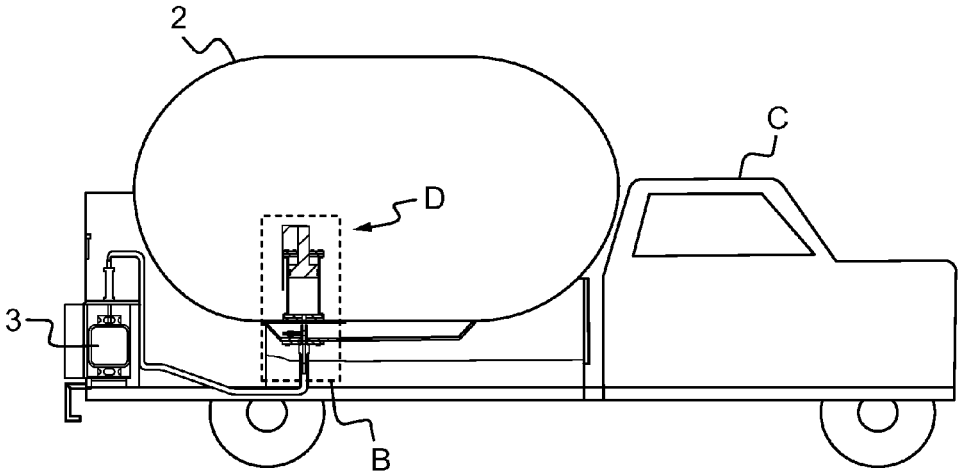
FIG. 11A shows an enlarged view of detail B of FIG. 10.

The gas input (D4) is connected to the reservoir (2) for a hose (D10); whereas the output (D5) is connected to the hose (15) that directs the gas to the cylinder (3) (see FIGS. 7 and 11).

The dosing device (D) also comprises two anti-return valves (D8, D9) installed in the gas input (D4) and output (D5), respectively. The valve (D8) allows the passage of gas from the reservoir (2) to the chamber (D6), on moving the piston (D3) of the body (D2) in the direction opposite to the input (D4) of the body (D2), but prevents passage in the opposite direction, whereas the valve (D9) allows the output of gas from the chamber (D6) but prevents its passage in the opposite direction, when the piston (D3) is shifted in the direction of the input (D4) of the body (D2), for bottling of gas in the cylinder (3).

The piston (D3) can be moved by any known means, for example, by a hydraulic pump (not shown) that injects or withdraws fluid through the opening (D11) of the chamber (D7) of the body (D2), opposite the chamber (D6) in relation to the piston (D3). In this way, on injecting fluid in the chamber (D7), the piston (D3) pushes against the gas of the chamber (D6), expelling it out of the body (D2) through the output (D5). Upon withdrawing the mentioned fluid or ceasing to inject it, the piston (D3) withdraws, due to the pressure of the gas contained in the chamber (D6) and also due to the negative pressure in the chamber (D7) with the withdrawal of fluid. The dosing device (D) can also contain a spring (not shown) arranged in the chamber (D6), pushing the piston (D3) and constantly forcing it in the direction opposite to the input (D4), allowing the chamber (D6) to remain full of gas, which is expelled through the output (D5), when the hydraulic pump (not shown) acts on the piston (D3).

The dosing device (D) can alternatively contain a plunger (D12) whose rod (D13) is connected to the piston (D3), promoting its backward or forward movement inside the body (D2). In this particular situation, the opening (D11) of the chamber (D7) allows air input or output, in accordance with the movement of the piston (D3), preventing the formation of vacuum in the chamber (D7). So that the dosing device (D) is refilled with gas, the rod (D13) of the plunger (D12) withdraws, withdrawing the piston (D3), allowing the gas to enter in the chamber (D6).

The position sensor (D1) can be installed in the piston (D3) or in the rod (D13) of the plunger (D12) or in the body (D2).

The dosing device gift (D) can be used connected to the reservoir (2) of the gas supply truck (C), which, in particular, comprises a funnel-shaped lower portion (21), so as to direct the liquefied gas to the input (D4) of the dosing device (D). In this situation, the hose (15) leaves the output (D5) and advances to the compartment (4) for gas cylinders (3).

Figure 11A:
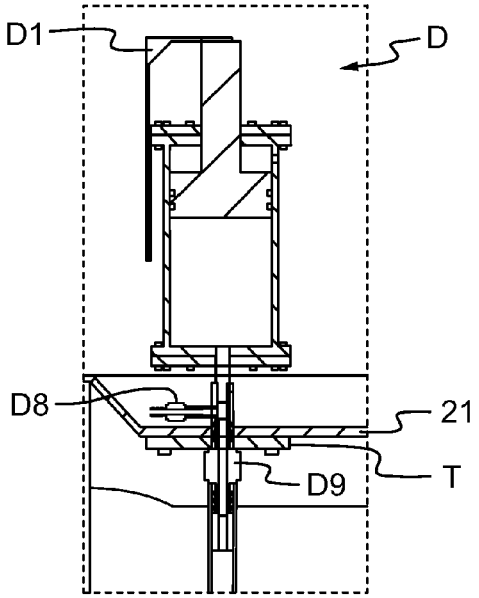
Figure 12:
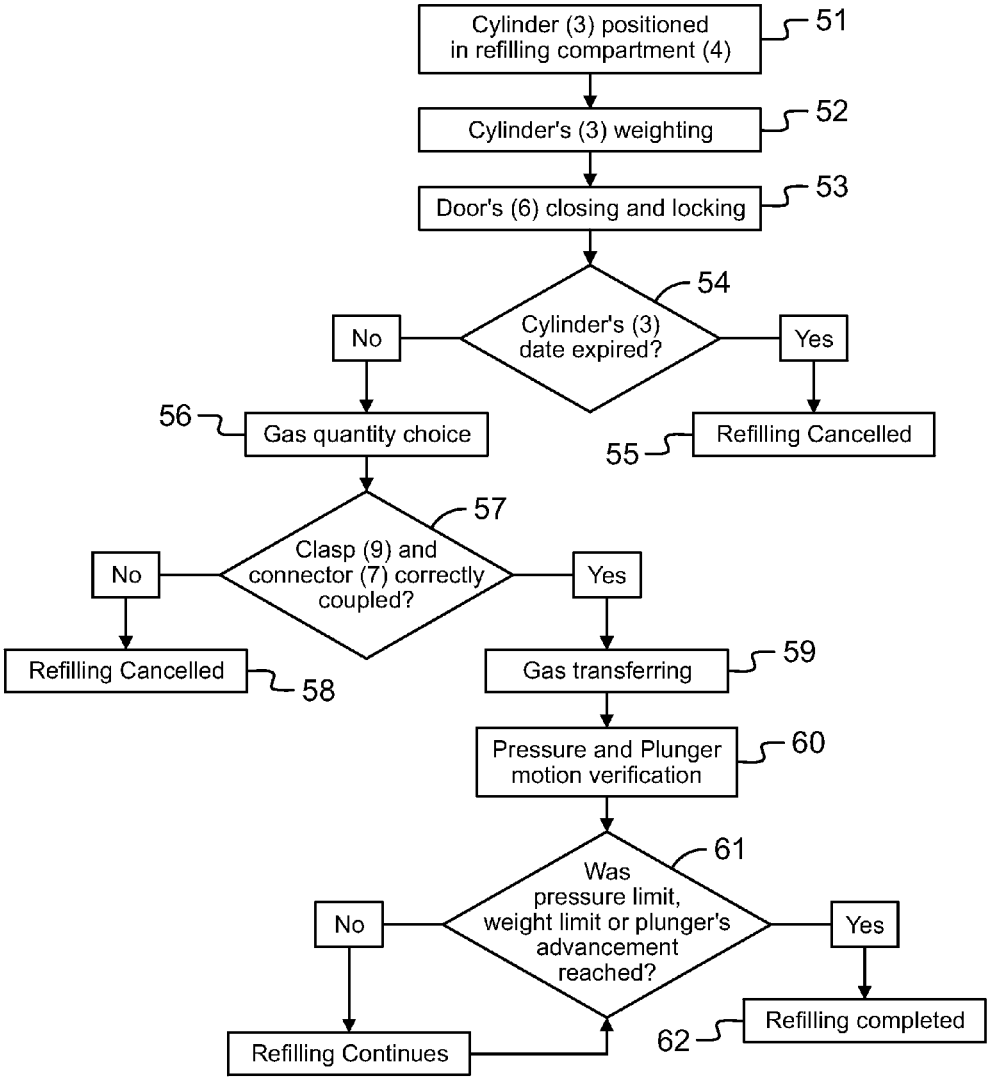
FIG. 12 presents a block diagram of the compact method of bottling gas.

The dosing device (D) can be installed inside or outside the gas reservoir (2). When installed inside the reservoir (2) (FIGS. 11 and 11A), due to being in an environment with gas, the input or output of gas occurs through the opening (D11), avoiding a vacuum in the chamber (D7). In this particular situation, the lower portion (21) of the reservoir (2) is closed by a cover (T) where the mentioned dosing device (D) is supported.

Figure 7A:
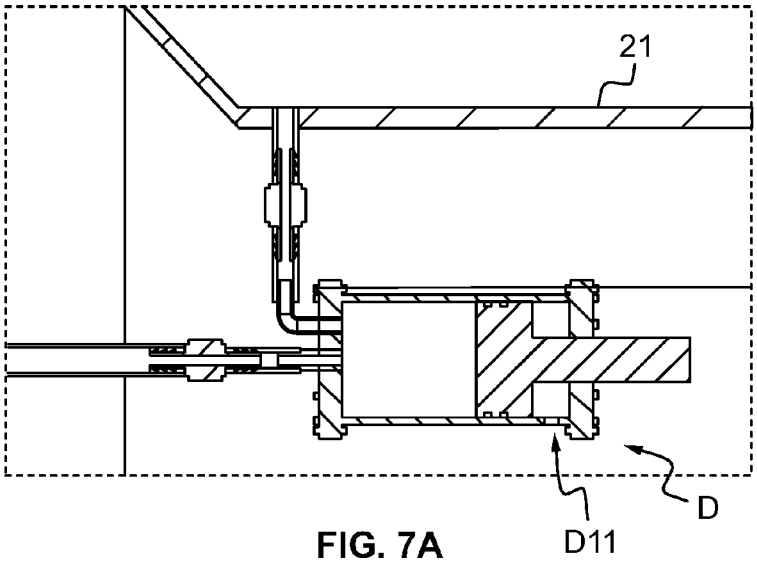
FIG. 7A shows an enlarged view of detail A of FIG. 7.

Additionally, when the said dosing device (D) is installed outside the reservoir (2) (see FIGS. 7 and 7A), the hose (D10) can comprise a coil (not shown) to assist in a primary stabilization of the temperature of the gas that enters the chamber (D6).

The gas enters the dosing device (D) through the hose (D10), passes through the valve (D8), proceeding to the chamber (D6), through the input (D4), at which time its temperature is measured for the beginning of the bottling process. After a quantity of gas by weight is chosen through the panel (5), the piston (D3) is actuated, making the gas exit the dosing device (D) toward the hose (15), which directs it to the cylinder (3).

As an additional safety measure, when the dosing device (D) is used, the weight measurement system (12) essentially assumes the function of assuring that the maximum weight of the cylinder (3) is not surpassed. Thus, if there should occur a system pressure monitoring failure, or a failure of the overload controlling mechanism associated with the safety valve of the connecting assembly (7), the weight measurement system (12) identifies the excess weight and communicates to the monitoring system to terminate the refill.

Figure 5:
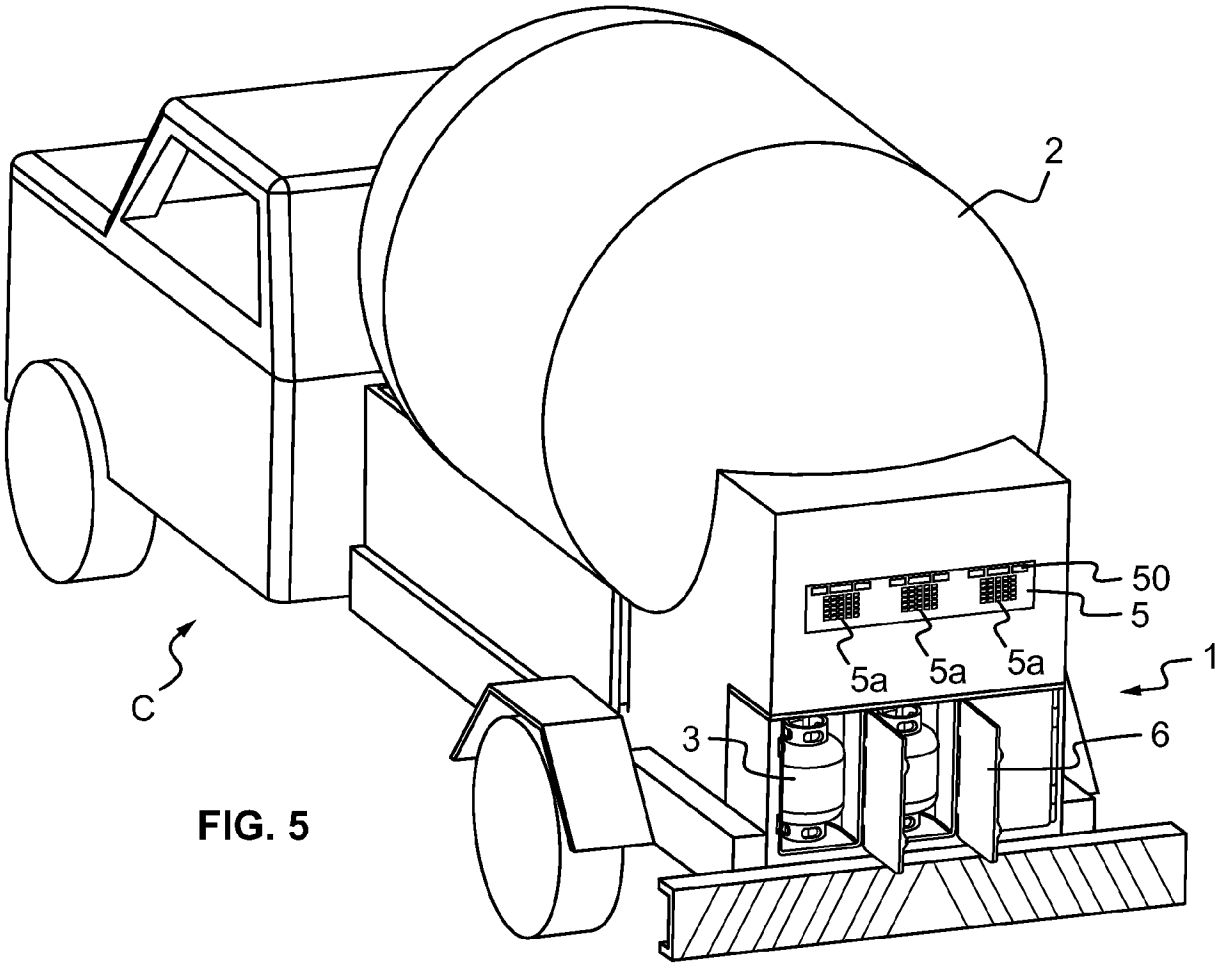
FIG. 5 shows a perspective view of the compact system of bottling gas (1), in one application example, which is a four-wheel vehicle (C)

In accordance with the application example of the present system (1) illustrated in FIG. 5, there are three compartments (4) placed in a truck (C) with a gas reservoir (2), which thus moves to residences to fill the cylinders (3) directly in the location.

Figure 6:
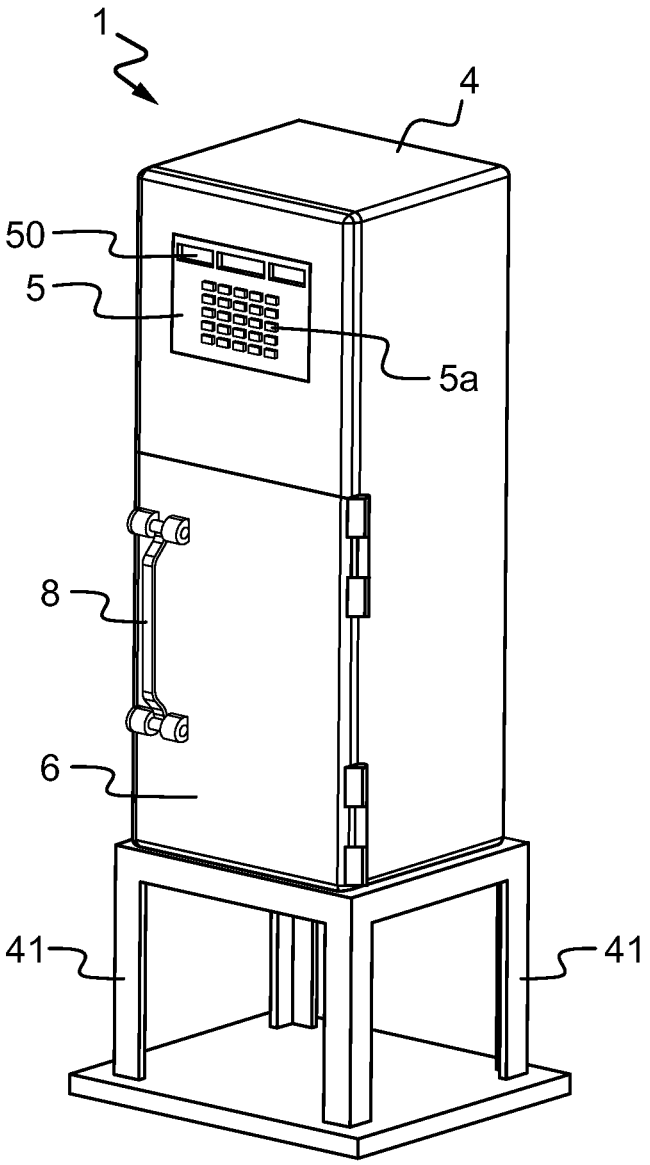
FIG. 6 shows one another application example of the present system (1), where compartment (4) is equipped with a base structure in the form of vertical rods (41), which keeps it off the ground where is fastened.

One another application example of the present system (1) is illustrated in FIG. 6, where the compartment (4) is fixed in a retail sales establishment, such as a gasoline station, a supermarket or shopping center parking lot, etc. In this particular situation, the compartment (4) is preferably located on a base structure, particularly in the form of vertical rods (41), which keep it off the floor.

Preferably, the bottling is done automatically, and therefore the present invention includes a gas bottling method that comprises the following steps:

1) Positioning of a cylinder (3) in the filling compartment (4);
2) Measurement of the weight of the cylinder (3);
3) Closing of the door (6) and activation of the connection means (8) of the compartment (4);
4) Reading of the information specified by the manufacturer concerning the validity date of the cylinder (3), by optical means, by a chip installed in the cylinder (3) or by any other means that ensures interpretation of the information;
5) Choice of a quantity of gas to bottle through the control panel (5);
6) Coupling of the fast coupler (9) on the connector (7) of the cylinder (3);
7) Transfer of the quantity of gas chosen in step (c), from the reservoir (2) to the cylinder (3);
8) Interruption of the gas transfer upon reaching the chosen value, the pressure limit of the cylinder (3) or the maximum weight of the cylinder (3);
9) Decoupling of the retractable support (9) from the fast coupler of the connector (7) of the cylinder (3);
10) Deactivation of the connection means (8) of the door (6) of the compartment (4);
11) Withdrawal of the cylinder (3).

As indicated in the first step (1), the cylinder (3) is located in the cradle (13) inside the box (40) which is on the measurement system (12), where its weight is measured. The cradle (13) keeps the connecting assembly (7) of the cylinder (3) centered with the fast coupler (9), allowing automatically a coupling of the coupler (9) on the connector (7).

In step (3), the safety door (6) of the compartment is closed (4), keeping the cylinder (3) enclosed. With the closing of the door (6), the connection means (8) is activated, at the same time as the retractable support (10) is actuated, moving the fast coupler (9) to its coupling in the connector (7) of the cylinder (3). A quantity of gas is then chosen to bottle, through the control panel (5).

A quantity of gas having been chosen, it is transferred from the reservoir (2) to the cylinder (3), while the measurement system (12) measures the change of weight of the cylinder (3). This transfer is carried out with the aid of a hydraulic or pneumatic pump (not shown) or with a dosing device (D).

The internal pressure of the cylinder (3) is monitored by the pressure sensor (not shown), located in the hose (15) or in the fast coupler (9), that thus interrupts the gas flow upon reaching the capacity limit of the cylinder (3). In this way, the gas transfer can be interrupted, not only when the chosen quantity of gas is reached, but also when the internal pressure of the cylinder (3) exceeds a predetermined maximum value for the cylinder (3).

When the level of gas chosen or the pressure limit of the cylinder (3) is reached, the refill is concluded, interrupting the gas flow from the reservoir (2) to the cylinder (3).

In this situation, the fast coupler (9) is decoupled from the connecting assembly (7), through drawing back of its retractable support (10), which releases the connection means (8) of the safety door (6), and the display (50) of the control panel (5) indicates the final price to be charged. The connection means (8) preferably is automated, it being able to be mechanical and equipped with a sensor that indicates if the door is closed or opened, releasing or terminating the gas refill.

The present compact system of bottling gas (1) can be used manually; in this option the fast coupler (9) in the connecting assembly (7) of the cylinder (3) is done by the operator before closing the compartment (4). After closing the compartment (4), the gas is released from the container (2) until the weight of the cylinder (3) reaches the desired value or its pressure limit is reached.

When a dosing device (D) is used or the present method further comprises the following steps, after step (6) of coupling the coupler (9) in the connector (7):

a) Activation of the dosing device (D) with verification of the temperature of the chamber (D6) and of the piston (D3) of the dosing device (D), for filling the total volume of the chamber (D6);

b) Calculation of the density of the gas, the quantity of gas in the chamber (D6) by mass; and the value of the advance of the piston (D3), from the temperature values of the chamber (D6), the initial position of the piston (D3) and the quantity of gas chosen in step (5);

c) Advance of the piston (D3) to the output of the gas to the hose (15);

d) Interruption of the advance of the piston (D3) if the pressure limit or the weight limit of the cylinder (3) is reached, or, if the position defined in step (b) is reached.

In this particular situation, the dosing device (D) is activated after coupling the coupler (9) in the connector (7), when the readings of the temperature of the chamber (D6) and the position of the piston (D3) are done, by the temperature (not shown) and position (D1) sensors.

After receiving these readings, the program of the processing and management unit of the panel (5) of the system (1) calculates the density of the gas, the quantity of gas by mass contained in the chamber (D6), and the advance of the piston (D3), so that the quantity of gas defined for the operator is bottled in the cylinder (3).

If the value of the mass contained in the chamber (D6) is inferior to the one chosen for refill of the cylinder (3), the piston (D3) is actuated for the input of more gas in the said chamber (D6), promoting its withdrawal from the body (D2).

If the value of the mass contained in the chamber (D6) is greater than the one chosen for refill of the cylinder (3), movement of the piston (D3) is activated to bottle the cylinder (3). This movement of the piston (D3) for bottling the cylinder (3) is interrupted after the chosen quantity of gas has been bottled in the cylinder (3).

In case the pressure in the cylinder (3) is surpassed, or the chosen weight is reached, the mentioned program of the processing and management unit interrupts the movement of the piston (D3), stopping the supplying of gas.

The scope of the present invention does not have to be limited to the illustrated example, but indeed, only to the terms defined in the claims and their equivalents.

The invention claimed is:

1. A system for filling a portable gas cylinder with a preselected quantity of fluid for supplying energy needs to a user, the system comprising a reservoir for supplying a volume of fluid, a compartment for receiving the gas cylinder, and a supply line extending between the reservoir and the compartment for delivering the pressurized fluid to the gas cylinder, characterized in that:

the compartment is enclosed and has a door that is accessible by a user only before and after a filling operation to load and unload the gas cylinder;

a retractable coupler is connected to the supply line, the coupler being located in the compartment and being automatically movable toward a fill valve on the gas cylinder during the filling operation to thereby connect with the fill valve and deliver a quantity of fluid under pressure to the gas cylinder from the reservoir;

a control panel having a user interface for selecting a quantity of pressurized fluid to be delivered to the gas cylinder;

a first sensor positioned for detecting when the preselected quantity of fluid has been delivered to the gas cylinder; and a processor operably associated with the control panel, the first sensor and the retractable coupler for automatically stopping the filling operation and moving the coupler way from the fill valve when the first sensor detects that the preselected quantity of fluid has been delivered to the gas cylinder.

2. A system for filling a portable gas cylinder according to claim 1, characterized in that the door includes a locking mechanism operable by the processor for automatically locking the door in a closed position during the filling operation and unlocking the door after the filling operation.

3. A system for filling a portable gas cylinder according to claim 1, characterized in that the first sensor determines one of a pressure limit and a weight limit for the gas cylinder.

4. A system for filling a portable gas cylinder according to claim 3, characterized in that the processor is operable to stop the filling operation before delivery of the preselected quantity of fluid is completed when the first sensor detects that the limit of the gas cylinder has been reached.

5. A system for filling a portable gas cylinder according to claim 4, characterized in that the first sensor determines at least one of a weight limit and volume limit for the gas cylinder.

6. A system for filling a portable gas cylinder according to claim 5, characterized in that a second sensor is provided for determining a pressure limit of the gas cylinder.

7. A system for filling a portable gas cylinder according to claim 6, characterized in that the processor is operable to stop the filling operation before delivery of the preselected quantity of fluid is completed when at least one of the first and second sensors detects that at least one of the weight limit, volume limit, and pressure limit of the gas cylinder has been reached.

8. A system for filling a portable gas cylinder according to claim 6, characterized in that the second sensor is located in the retractable coupler.

9. A system for filling a portable gas cylinder according to claim 1, characterized in that a cradle is located in the compartment for receiving the gas cylinder so that the fill valve on the gas cylinder is in alignment with the retractable coupler.

10. A system for filling a portable gas cylinder according to claim 9, characterized in that the first sensor comprises a load cell located beneath the cradle for sensing the weight of the gas cylinder.

11. A system for filling a portable gas cylinder according to claim 1, characterized in that a further sensor is provided for determining a correct connection between the retractable coupler and the fill valve on the gas cylinder, the processor being operable to cancel the fill operation and retract the coupler when an incorrect connection has occurred.

12. A system for filling a portable gas cylinder according to claim 1, characterized in that a display is coupled to the processor for indicating a selected quantity of fluid to be delivered to the gas cylinder and for indicating completion of the filling operation.

13. A system for filling a portable gas cylinder according claim 1, characterized in that a fluid dosing device is operably associated with the reservoir for transferring the fluid from the reservoir to the gas cylinder.

14. A system for filling a portable gas cylinder according to claim 13, characterized in that the fluid dosing device comprises a hollow body, a piston located in the hollow body for reciprocal movement with respect thereto, an input fluidly connected to the reservoir, and an output fluidly connected to the supply line, such that movement of the piston in one direction causes fluid to enter the hollow body through the input from the reservoir, and movement of the piston in the opposite direction causes fluid to flow through the output and into the supply line.

15. A system for filling a portable gas cylinder according to claim 14, characterized in that the dosing device further comprises a temperature sensor associated with the hollow body and a position sensor associated with the piston, the temperature and position sensors being in communication with the processor to thereby calculate and control movement of the piston to deliver the preselected quantity of fluid based on a change in volume of the fluid due to a change in temperature.

16. A system for filling a portable gas cylinder according to claim 1, characterized in that the gas cylinder comprises electronic information relating to a valid use date and further comprising a reader to detect the use date, the processor being operably associated with the reader to determine a valid or expired status of the gas cylinder.

17. A system for filling a portable gas cylinder according to claim 1, characterized in that the compartment is mounted on a stationary support.

18. A system for filling a portable gas cylinder according to claim 1, characterized in that the reservoir and compartment are mounted on a motorized vehicle for transporting the system to different locations.

19. A system for filling a portable gas cylinder according to claim 17, characterized in that a plurality of compartments are provided, each compartment having a separate and independently operable door, retractable coupler, control panel, and first sensor operably connected to at least one controller.

20. A method of filling a portable gas cylinder that uses the system of claim 1, characterized in that it comprises the following steps:

positioning a gas cylinder in the compartment;

locking the compartment door in a closed position to prevent access by a user;

programming a preselected quantity of fluid to be transferred from the reservoir to the gas cylinder;

moving the retractable coupler toward the fill valve on the gas cylinder to thereby connect the coupler to the fill valve;

determining that a proper connection has occurred between the coupler and the fill valve;

directing fluid from the reservoir to the gas cylinder through the supply line;

stopping the flow of fluid from the reservoir when it has been determined that the predetermined quantity of fluid has been transferred;

retracting the coupler from the fill valve; and unlocking the compartment door to allow access by a user to remove the gas cylinder from the compartment.

21. A method of filling a portable gas cylinder according to claim 20, characterized in that the filling operation is stopped and the compartment door is unlocked before the predetermined quantity of fluid has been transferred to the gas cylinder when at least one of the following conditions has occurred: 1) a pressure limit of the gas cylinder has been reached; 2) a weight limit of the gas cylinder has been reached; and 3) an incorrect connection between the retractable coupler and the fill valve has occurred.

22. A method of filling a portable gas cylinder according to claim 20, characterized in that it further comprises the steps of detecting a valid use date of the gas cylinder prior to connecting the coupler to the fill valve, and unlocking the compartment door to permit a user to remove the gas cylinder without transferring fluid to the gas cylinder.

* * * * *